US006072443A

United States Patent [19]

Nasserbakht et al.

[11] Patent Number: 6,072,443

[45] Date of Patent: Jun. 6, 2000

[54] ADAPTIVE OCULAR PROJECTION DISPLAY

[75] Inventors: Gitty N. Nasserbakht; Martin J. Izzard, both of Dallas, Tex.

[73] Assignee: Texas Instruments Incorporated, Dallas, Tex.

[21] Appl. No.: 08/625,478

[22] Filed: Mar. 29, 1996

[51] Int. Cl.[7] ..... G09G 5/00

[52] U.S. Cl. ..... 345/7; 345/156; 348/78; 351/208

[58] Field of Search ..... 345/7, 8, 9, 6, 345/175, 32, 156, 158; 348/53, 51, 56, 341, 345, 115, 78; 359/630, 631, 370, 577; 351/208, 210, 211, 201

[56] References Cited

U.S. PATENT DOCUMENTS

| | | | |
|---|---|---|---|
| 4,712,894 | 12/1987 | Nunokawa | 351/208 |
| 4,740,780 | 4/1988 | Brown et al. | 345/7 |
| 5,061,996 | 10/1991 | Schiffman | 345/7 |
| 5,467,104 | 11/1995 | Furness, III et al. | 345/8 |
| 5,499,138 | 3/1996 | Iba | 345/8 |
| 5,502,514 | 3/1996 | Vogeley et al. | 345/175 |
| 5,574,473 | 11/1996 | Sekiguchi | 345/8 |
| 5,583,335 | 12/1996 | Spitzer et al. | 345/7 |
| 5,644,323 | 7/1997 | Hildebrand et al. | 345/8 |
| 5,825,456 | 10/1998 | Tabata et al. | 351/201 |

*Primary Examiner*—Dennis-Doon Chow
*Attorney, Agent, or Firm*—Ronald O. Neerings; Frederick j. Telecky, Jr.

[57] ABSTRACT

An ocular projection display (12) projects an image directly to the eye (26) of the user (10). The focus of the image may be varied to allow for different user profiles or to relieve the stress of maintaining a fixed focus over a prolonged period of time. Optionally, the ocular projection display (12) can include a location and distance sensor (46) for identifying the location of the user's eyes for proper aiming of the image to the eyes of the user and focus detection circuitry (54) to correct for the user's focusing abilities.

29 Claims, 4 Drawing Sheets

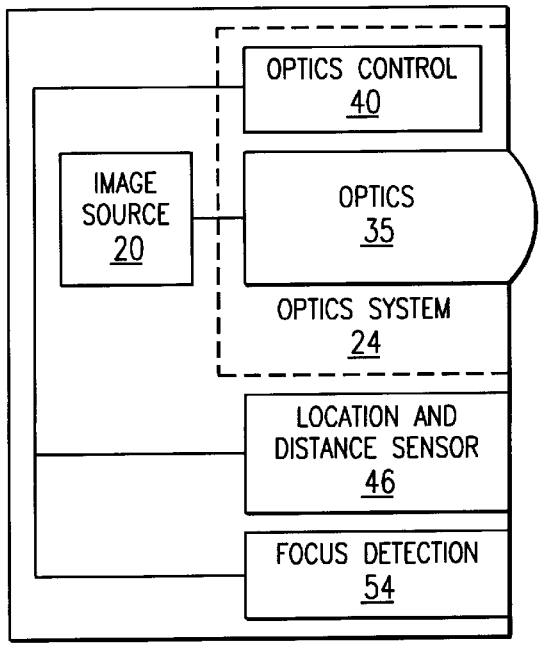
FIG. 8
FIG. 9
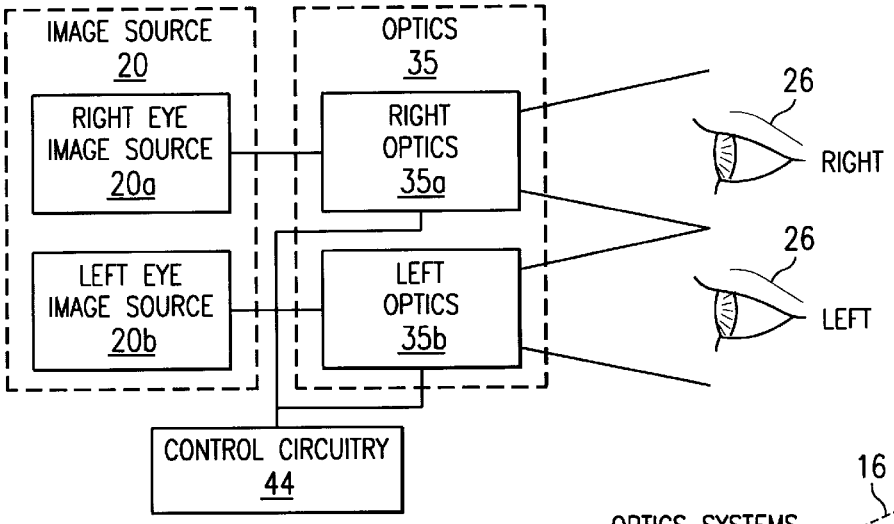
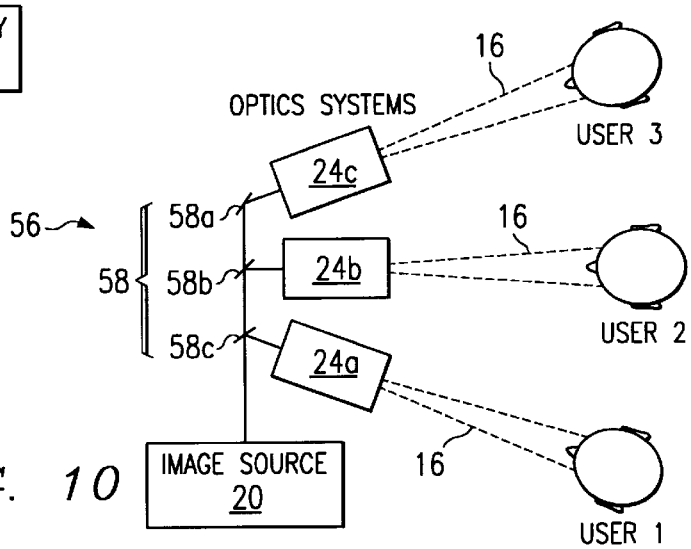
FIG. 10

ADAPTIVE OCULAR PROJECTION DISPLAY

BACKGROUND OF THE INVENTION

1. Technical Field

This invention relates in general to user interfaces and, more particularly, to a visual projection device.

2. Description of Prior Art

Many electronic devices require a visual user interface. Examples of devices which require a visual user interface include, but are not limited to, computers, electronic video games, and televisions. The most prevalent visual user interface is the cathode ray tube (CRT), which creates an image by illuminating phosphors on a screen. Another common visual interface device is the liquid crystal display (LCD) which is used in portable electronics, such as notebook computers and hand-held televisions.

While providing a clear picture, cathode ray tubes have several shortcomings. First, the size of a display using cathode ray tube technology is extremely bulky. Even fairly small displays (12" or 14" diagonal) are far too bulky for portability. Second, the cost of a CRT increases dramatically as the size of the screen is increased. Third, the flyback transformer used in a CRT generates a significant magnetic field, which some believe may cause medical problems.

LCD screens have similar disadvantages. First, the clarity of an LCD screen is inferior to a CRT, and it may diminish significantly from the optimum if lighting conditions are not perfect. Second, the cost of the screen increases significantly with size. Screens of medium size, such as 17" screens, are not commercially available.

More significantly, both screens result in eye fatigue after use over extended periods of time. One cause of eye fatigue is the user's constant focus on a screen which is a set distance from the user's eyes. Such constant focus can result not only in eye weariness, but also in headaches and tension. To combat fatigue, many users take frequent breaks; however, this results in a loss of productivity.

Another problem is use of the screen to output three dimensional (3D) information. One method to output 3D information from a CRT or LCD uses special glasses which are synchronized to the output on the screen. The right and left eye pieces of the glasses are alternately blocked, inhibiting the user's vision of the screen by the blocked eye. By outputting a picture at a first perspective when the right eye is blocked and the same picture at a slightly different perspective when the left eye is blocked, a 3D image is received by the user. However, the special glasses are expensive and uncomfortable to wear for extended periods of time.

Yet another problem with prior art displays is the ability for other people to see the output of the display. In many situations, such as during use of a portable computer in an airport terminal, it is desirable for the output of the computer to be private to the user. Even in office settings, it may be desirable to restrict viewing of the output of a computer to the user. While some present day LCD displays have a limited range of viewing, they can still be seen by people substantially behind the user.

Therefore, a need has arisen for a display system for providing a high quality image to the user while decreasing eye fatigue.

SUMMARY OF THE INVENTION

A display comprises an image source for providing an illuminated image and an optics system disposed between the image source and a user's face for generating a beam of light directing said illuminated image to an area substantially on the user's face, such that the image may be received and focused by at least one eye of the user.

The present invention provides significant advantages over the prior art. First, the display works in conjunction with the user's eyes. Thus, using optical techniques, the display can modify the image to enhance viewing by the user. For example, the image can be modified slightly during transmission such that the user may change focus slightly to reduce fatigue. Also, the size of the display can be changed to any size desired by the user without any change in hardware. Far- or near-sighted users can use the display without corrective lenses, because the display can compensate for focusing deficiencies.

Second, a three dimensional image can be received by the user by transmitting two images defined at slightly different perspectives to each eye of the user. Third, the display can automatically adjust to the location and personal characteristics of the user.

BRIEF DESCRIPTION OF THE DRAWINGS

For a more complete understanding of the present invention, and the advantages thereof, reference is now made to the following descriptions taken in conjunction with the accompanying drawings, in which:

FIG. 8 illustrates a diagram of a third embodiment of the ocular projection display;

FIG. 9 illustrates a diagram of the ocular projection display for independent right and left eye images; and FIG. 10 illustrates a diagram of the ocular projection display for multiple users.

DETAILED DESCRIPTION OF THE PREFERRED EMBODIMENT

The present invention is best understood in relation to FIGS. 1–10 of the drawings, like numerals being used for like elements of the various drawings.

Figure 1:
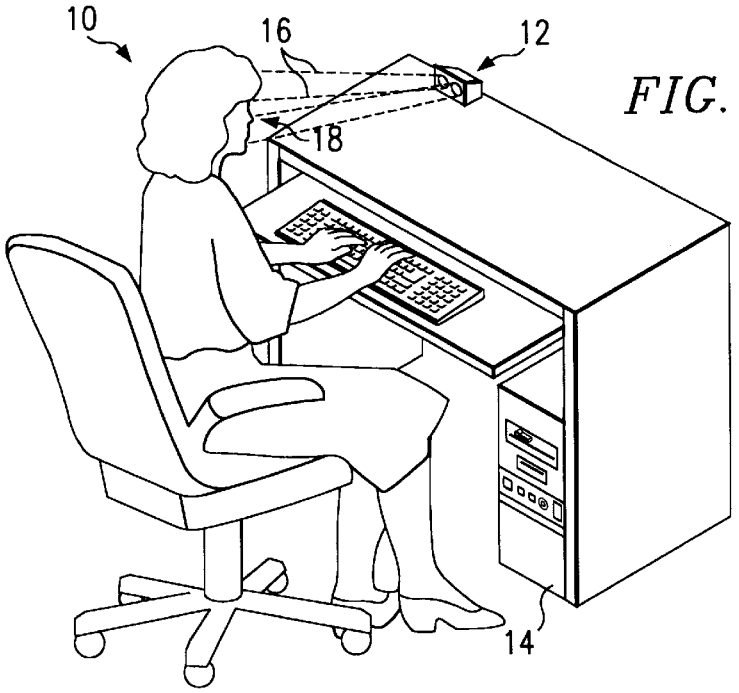
FIG. 1 illustrates a perspective view of an ocular projection display in use with a computer.

FIG. 1 illustrates a perspective view of a user 10 using an ocular projection display 12, in an embodiment where the ocular projection display 12 is used as a display for a computer 14. In the illustrated embodiment of FIG. 1, the ocular projection display 12 generates two collimated beams of light 16 to the face 18 of the user 10 for a three dimensional image. To generate a two dimensional image, only a single beam 16 is necessary. The collimated beam(s) are focused by the eyes of the user 10 to render an image on the user's retina.

As described in greater detail hereinbelow, the image generated by the ocular projection display 12 can be made to appear at varying distances and at varying sizes. Hence, in the embodiment set forth in FIG. 1, the computer output could be made to appear as the output of any size monitor, at any distance from the user.

The ocular projection display 12 may be used for many purposes. One primary use, shown in FIG. 1, is that of a display for use with a desktop or portable computer. Other uses would include video or television display, video game machine or eye exercise machine, described in greater detail hereinbelow.

One advantage of the ocular projection display is that it may be designed to slowly change the apparent distance of the image displayed by the monitor from the user during use, thereby allowing the user's eyes to change focus during work. This change in focus can reduce or eliminate fatigue associated with long hours reading from a computer monitor.

Figure 2A:
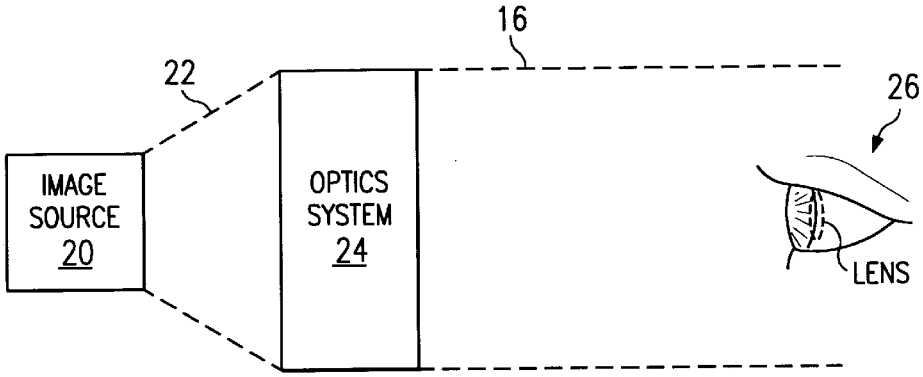
FIG. 2*a* illustrates a block diagram of a first embodiment of the ocular projection display.

A base system for the ocular display (for a single eye) is shown in block diagram form in FIG. 2*a*. An image source 20 generates a beam of light 22 through optics system 24. Optics system 24 focuses the beam 22 to a collimated beam of light 16 directed to the face of the user (as shown in greater detail in connection with FIGS. 2*b* and 2*c*) proximate the eye of the user. The user's eye 26 focuses the beam to generate a clearly focused image on the user's retina.

The image source 20 may be any source suitable for generating light at sufficient brightness to project the image to the user. Typically, the user will be seated two to three feet from the image source 20 in a computer application, although greater distances may be appropriate for other applications. The necessary brightness will thus depend upon the application.

In a conventional display, such as a CRT or an LCD display, the image exists on a plane (i.e., the screen), which is a fixed distance from the user. To focus the image, the lenses of the user's eyes attain a thickness dependent upon the distance between the user's eyes and the screen. With the ocular projection display, the output image from the image source 20 is projected to the user's eyes and is focused by the optics system 24 in conjunction with the lenses of the user's eyes to produce a focused image on the user's retinas. Accordingly, the lenses of the user's eyes will focus at a distance controlled by the optics system, rather than at a distance dependent solely upon a distance between the user and a screen. Similarly, the optics system 24 can control the apparent size of the image presented to the user—i.e., a computer screen can appear large or small to the user.

Figure 2B:
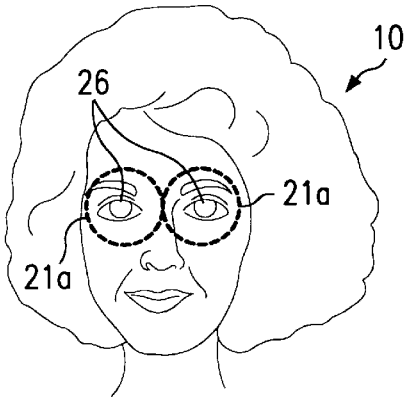
FIGS. 2*b* and 2*c* illustrate areas of impingement of light from the ocular projection display in three-dimensional and two-dimensional modes.
Figure 2C:
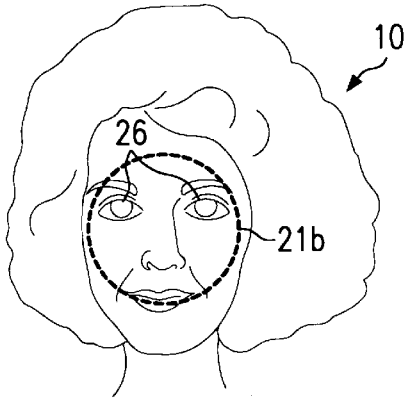

FIGS. 2*b* and 2*c* show the areas of the user's face illuminated by the image source 20 in the preferred embodiment. In FIG. 2*b*, the user is receiving images from two image sources 20 to provide a three dimensional image. Each beam 16 illuminates a respective area 21*a* proximate to each eye of the user. In FIG. 2*c*, the user receives a single image from an image source 20. The image source 20 illuminates an area 21*b* around both eyes of the user.

By illuminating only the necessary area(s) of the user's face, the output of the display is private to the user. Therefore, the output of the display can be restricted from other persons in the immediate area for greater security.

Figure 3:
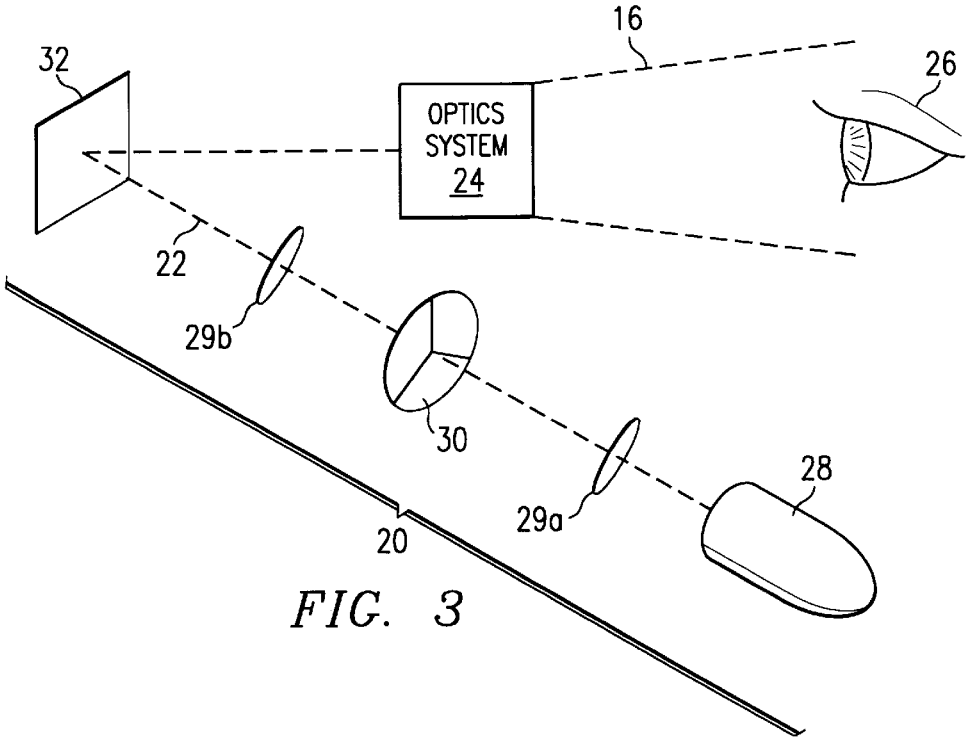
FIG. 3 illustrates a diagram of an image source.

FIG. 3 shows a preferred embodiment for the ocular projection display 12. A light source 28 produces a beam of light which passes through lens 29*a*, color wheel 30, and lens 29*b*. The beam reflects off DMD (digital mirror device) 32. The reflected image of the DMD 32 passes through optics system 24. The beam 16 which emerges from optics system 24 is received by the user's eye and focused. It should be noted that other image sources, such as a cathode ray tube, could also be used as the image source 28.

In operation, the color wheel changes the color of the light from the light source 28 to one of the primary colors (red, blue or green). The DMD 32 is an array of electronically controlled mirrors, each mirror corresponding to a pixel of the display, along with the electronic logic, memory and control circuitry required for precise control of the mirror's movement. The wheel rotates in synchronization with the DMD 32 to generate the color image. In other words, while the light source is passing through a given color on the wheel, the DMD 32 has its mirrors set to output the correct value of the that color for each pixel. Each mirror can be set to fully reflect the light, not reflect any light or oscillate between reflecting and not reflecting states in order to create any desired intensity.

Use of DMD devices to produce a color image is described in greater detail in R. J. Gove, "DMD Display Systems: The Impact of an All-Digital Display", Society for Information Display (June 1994). It should be noted that for a monochrome image, the color wheel is not needed. Also, a color image can be generated by use of three DMD devices 32, one for each primary color (red, blue and green) without need for a color wheel.

Figure 4:
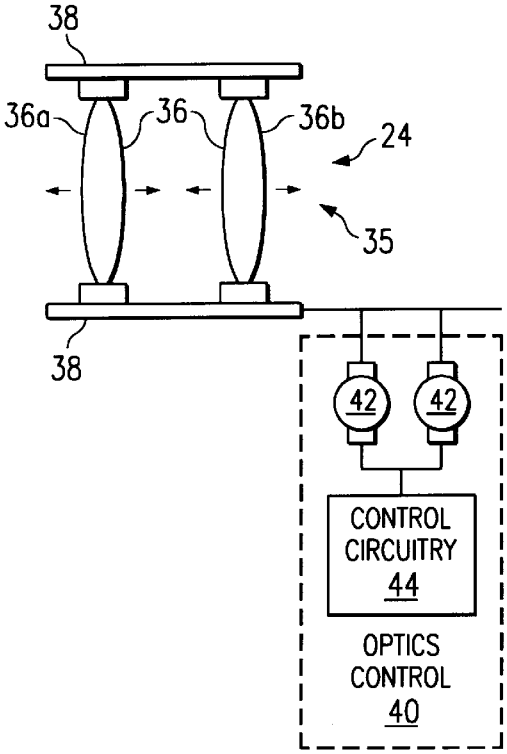
FIG. 4 illustrates a diagram of an optics system.

A diagram of optics system 24 can be seen in greater detail in FIG. 4. Optics 35 comprise a plurality of lenses 36 (referenced individually as 36*a* and 36*b*) are mounted within housing 38, such that at least one of said lenses 36 can be individually moved within the housing 38 under control of optics control 40. Optics control 40 includes stepper motors 42 which are controlled by control circuitry 44.

In operation, the optics subsystem 24 may comprise any number and type of lenses, as necessary to create the desired effects on the image. For example, to vary the focus during operation of the ocular projection display 12, only two lenses are necessary. For more complex operations, such as varying the apparent size of the image or varying the size of the areas of illumination (see FIGS. 2*b* and 2*c*), more lenses are needed, as is known in the art. Thus, the number of lenses, and associated control, can be designed as necessary to achieve desired effects.

Figure 5:
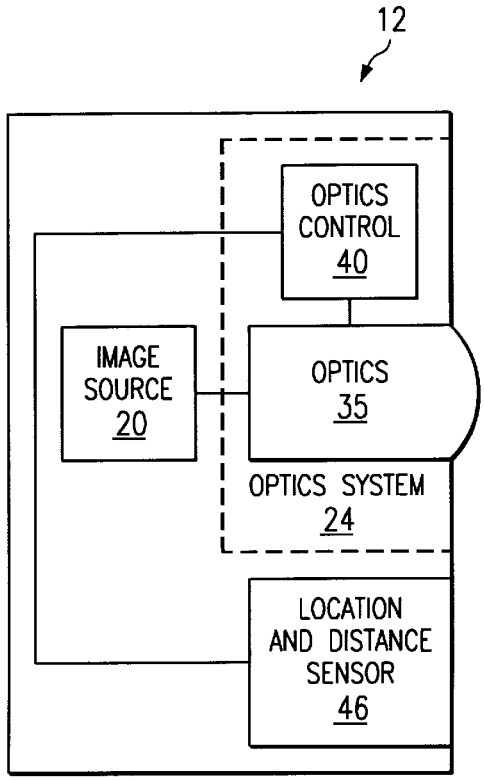
FIG. 5 illustrates a diagram of a second embodiment of the ocular projection display.

FIG. 5 illustrates a block diagram of an embodiment with enhanced setup features. As in FIG. 2, image source 20 generates a beam of light through optics 35. Optics 35 are controlled by optics control 40. Optics control 40 receives information from location and distance sensor 46 for modifying the image from image source 20 responsive to the location of the user relative to the ocular projection display 12.

In operation, the location and distance sensor 46 determines the general location of the user's face 18 and eyes 26. Further, the distance between the ocular projection display 12 and the user's eyes 26 is determined. The location is used for the optics control 40 (see embodiment of FIG. 8) to point the ocular projection display 12 towards the user's eyes 26 and to set the focus of optics 35 to the correct distance.

Figure 6:
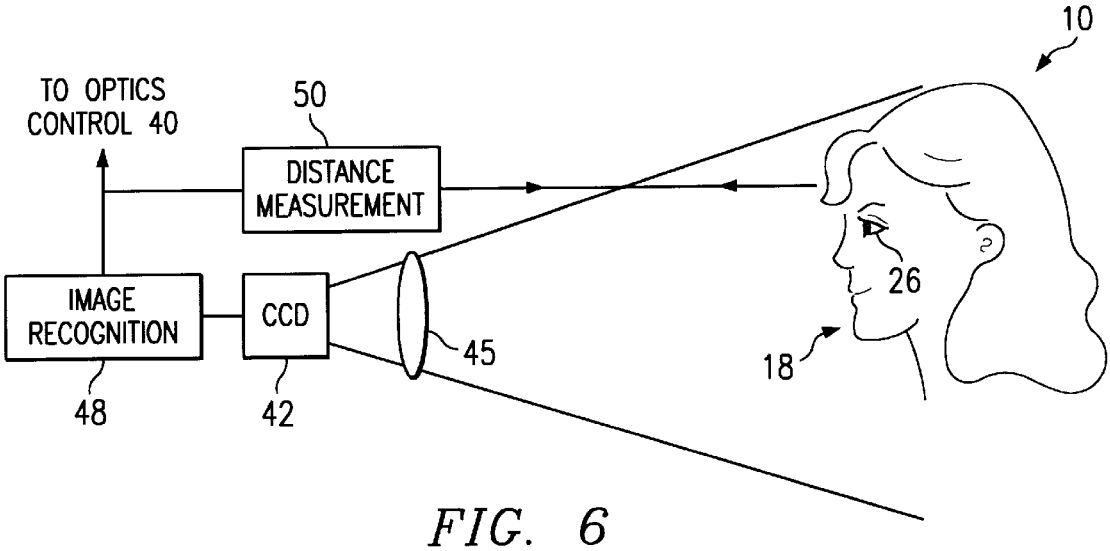
FIG. 6 illustrates a diagram of the location and distance sensor of FIG. 5.

The location and distance sensor 46 is shown in greater detail in connection with FIG. 6. A CCD (charge coupled device) 42 or similar device receives an image of the area generally in front of the ocular projection display 12 through lens assembly 45. The output of CCD 42 is input to image recognition circuitry 48. Distance measurement device 50 generates a beam which is reflected off an object in front of ocular projection display 12, and receives the reflected beam to determine distance to such object.

In operation, the CCD 42 receives an image which should include the head of a user who is sitting generally in front of ocular projection display 12. CCD 42 is of the type typically used in video cameras, and produces digital data describing the received image. This image data is sent to image recognition circuitry 48, which determines whether a portion of the image comprises a face. Such recognition can be performed by comparing data from the CCD image with user independent data profiles generally known in the art. From the detection of the face in the received image, the location of the eyes can be generally determined. This area can be searched for the location of the user's eyes (or glasses), again using user independent eye profiles. For a single beam 16, since the area 21*b* (see FIG. 1*c*) is larger and does not need to be as precisely located on the user's face, as in the case of stereo beams (see FIG. 1*b*), the information on the desired location on the user's face 18 can be determined from the face profile itself, without the need for further recognition of the eye profiles. Information on the location of the user's face 18 is sent to the optics control circuitry 40 to point the ocular projection display such that the beams 16 are pointing towards the user's eyes.

It is expected that the proper aiming of the ocular projection display can be performed based on calculations from the initial face and eye profiles. The aiming can be further refined, however, by the recursively performing recognition of the face and eye profiles until the profiles are in predetermined locations relative to the image received by the CCD 42.

The distance measurement device 50 can be based on existing technology for measuring distance; for example, using a reflected infra-red (IR) beam or sound waves. The distance measurement should be directed toward the area proximate the user's eyes and, therefore, should probably be updated as the image recognition circuitry and the optics control circuitry refine the aiming of the ocular projection display towards the user's eyes. In an alternative embodiment, the distance measurement circuitry 50 could be a function of he image recognition circuitry 48, using autofocus techniques found on commercial video cameras.

Figure 7:
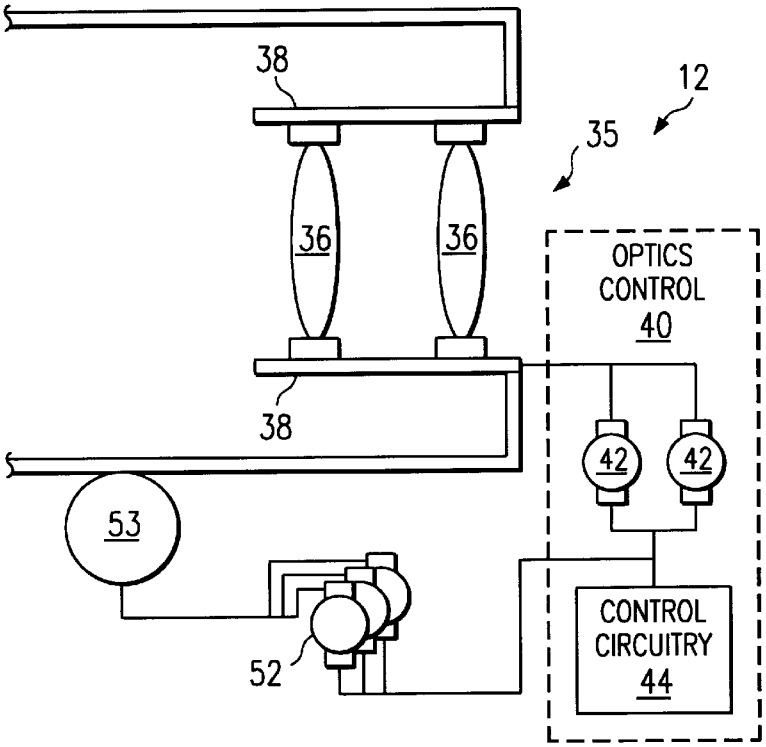
FIG. 7 illustrates a diagram of a second embodiment of the optics system.

FIG. 7 illustrates a schematic diagram of the optics control 40 used with the embodiment of FIG. 6. As described in connection with FIG. 4, a plurality of lenses 36 (referenced individually as 36*a* and 36*b*) are mounted within housing 38, such that the lenses 36 can be individually moved within the housing 38 under control of stepper motors 42. Stepper motors 42 are controlled by control circuitry 44. In addition, FIG. 7 includes a group of one or more additional stepper motors 52 which control the aiming of the ocular projection display 12 via swivel mount 53.

The number of motors 52 is dependent upon the degrees of motion desired in the swivel mount 53. In a simple embodiment, it can be assumed that the user will be sitting directly in front of the ocular projection display 12 and the only adjustment will be the vertical placement of the user's eyes, which will vary with the height and position of the user 10. In a more sophisticated embodiment, two motors allow the ocular projection display to be aimed both vertically and laterally, such that the user does not need to be located directly in front of the display 12, relative to a horizontal scale. Thus, the ocular projection display can track both lateral and horizontal movements of the user, which further decreases fatigue associated with maintaining a fixed position.

A third embodiment, uses three motors to additionally adjust to head tilts, such that the plane of the user's eyes is not horizontal. This embodiment is generally not needed for a single beam. While there is some leeway in head tilting afforded by the areas 21*a* surrounding the user's eyes, the tilt adjustment provides a greater degree of freedom to the user.

A fourth embodiment provides independent aiming of beams directed to the right and left eyes of the user. While the beams 16 will create an area 21*a* of illumination on the user such that a wide variety of facial variations will be covered without independent aiming, this feature provides areas of illumination centered about the user's eyes with greater precision.

In the preferred embodiment, the location and distance sensors operate both for the initial setup and during operation of the system to track the movement of the user's head as the computer is being used. Because the user's eyes will adjust to small variations in focus by themselves and because the areas 21 of illumination around the user's eyes allow for some movement without loss of image, the optics control 40 can use damping to avoid sharp changes in focus or location which would be distracting to the user.

FIG. 8 illustrates another embodiment, which provides enhanced features in connection with the user's personal vision capabilities. As in FIG. 5, image source 20 generates a beam of light through optics 35. Optics 35 are controlled by optics control 40. Optics control 40 is controlled by location and distance sensor 46. Further, focus detection circuitry 54 determines personal characteristics of the user's eyes and transmits this data to optics control 40, which can adjust focus to compensate for the user's nearsightedness or far-sightedness.

Devices which can automatically determine the nearsightedness or far-sightedness of the user are manufactured by Kabushiki Kaisha Topcon of Tokyo, Japan, and are described in U.S. Pat. No. 4,859,051 to Fukuma et al, entitled "Eye Testing Apparatus", which is incorporated by reference herein.

In the preferred embodiment, the focus detection circuitry determines a user's vision capabilities whenever a new user is detected. In conjunction with the image recognition circuitry 48, the presence of glasses can be detected; if the user is wearing glasses, it can be assumed that the glasses will correct the user's vision; therefore, additional corrective measures do not need to be performed by the focus detection circuitry 54.

In one embodiment, the focus detection circuitry 54 can store the vision characteristics of one or more users, such that the automatic detection of the user's capabilities by focus detection circuitry 54 can be overridden.

FIG. 9 illustrates an embodiment of the ocular projection display 12 for use in three dimensional applications. This embodiment uses a right eye image source 20*a* and a left eye image source 20*b* to generate images from which the user perceives three dimensions. Stereoscopic images of this type are well known in the art. If the images generated by the right and left image sources 20*a–b* are identical, a two dimensional image will be perceived by the user.

In the illustrated embodiment, each of the right and left image sources 20*a–b* are passed through respective optics 35, comprising individual right and left optics 35*a* and 35*b*, to be independently received by the user's right and left eyes, respectively. The right and left optics 35*a–b* can be independently focused, such that a user with different vision characteristics in each eye can view the images without glasses. Alternatively, both right and left image sources 20*a–b* could pass an image through a single lens assembly, without the ability to separately focus the images. The optics 35*a–b* are controlled by optics control 40. It should be noted that the features of FIGS. 5–8 can be incorporated into the embodiment of FIG. 9, although not shown therein.

In operation, the right eye image source 20*a* provides an image for the user's right eye, while the left eye image source 20*b* provides the image for the user's left eye. Accordingly, the user's right and left eyes can view images denoting a slightly different perspective, thereby producing a three dimensional effect.

FIG. 10 illustrates a multi-user ocular projection display 56, where multiple users can view images from a single source, such as a computer or video system. An image source 20 (which may comprise right and left images sources 20*a* and 20*b*) outputs an image to a first beam splitter 58*a*. The first beam splitter 58*a* reflects a predetermined amount of light from the image source 20 to a first optics system 24*a* and passes a predetermined amount of light from the image source 20 to a second beam splitter 58*b*. The amount of light passed will depend on the number of optics systems 24 in the multi-user ocular projection system 56. In the embodiment shown in FIG. 10, the first beam splitter will reflect one third of the light from the image source 20 to the first optics system 24*a* and pass two thirds of the light from the image source 20 to the second beam splitter 58*b*. Alternatively, multiple image sources could be used in place of splitting the light beam from a single image source 20.

The light passed by the first beam splitter 58*a* is split by the second beam splitter 58*b*. The second beam splitter 58*b* reflects a predetermined portion of the light to optics system 24*b* and passes a predetermined portion to reflector 60. Reflector 60 reflects the light passed by second beam splitter 58*b* to optics system 24*c*.

In operation, the light from the image source is split between multiple optics systems 24, each of which focus the light for direct viewing by respective users. Once again, it should be noted that the features of FIGS. 5–8 can be incorporated into the embodiment of FIG. 10, although not shown therein.

While FIG. 10 shows one embodiment for splitting the light from the image source between three optics systems, other embodiments, such as using optical fibers, could also be employed.

The ocular projection display has several applications. First, it can be used as an eye exercise machine. In this embodiment, the user receives an image from the ocular projection display 12 such that the image appears a predetermined distance from the user. The user's eyes will thus focus to the predetermined distance. From the predetermined focus distance, the focus of optics 35 will be varied by optics control 40 such that the user's focus gradually varies as the generated image appears to move closer and farther away from the user. Such an exercise both strengthens the user's eyes, and can also be used to reduce fatigue.

A second application is the use of the ocular projection display 12 in connection with a computer system. The ocular projection display has several advantages over current displays. First, the display can project an image which can appear as a computer screen of any desired size, without any change in the cost of the hardware, unlike present day monitors which increase drastically as the size of the screen is increased. Second, the output of the ocular projections display 12 is private to the user, enhancing system security, especially in non-secure settings, such as in airports. Third, the ocular projection display can be made in a small box, suitable for portable applications. Fourth, the ocular projection system can display three dimensional images by generating separate images for the user's right and left eyes. Unlike other three dimensional systems, the ocular projection display does not require the user to wear special lenses or other headgear in order to receive the three dimensional images. Also, unlike three dimensional systems which alternately block the right and left eyes of the user, the ocular projection display 12 generates continuous images to both eyes. This method is much closer to natural stereoscopic vision and is believed to be less tiring, especially over long periods of time.

Three dimensional images are expected to be used in many future multimedia application for computers. It should be noted, however, that the three dimensional viewing of the ocular projection display could also be used in conjunction with non-interactive video programs, such as television and linear video as well.

Another advantage of using the ocular projection display 12 with a computer is that background images can be displayed behind the computer screen, where the background images can appear to be at a different distance from the user than the screen. This allows the user to view the background image, such as a forest scene, to change focus and relax the user's eyes.

Another technique which can be used to relax a computer user's eyes is to change the user's focus during operation of the display in order to reduce fatigue. To reduce any distraction, the change in focus should be smooth and gradual.

The ocular projection display also provides an advantage to users with near- or far-sightedness. Either manually or automatically, the user's vision impairment can be entered into the system, such that the display can be used with or without glasses or contacts.

Although the Detailed Description of the invention has been directed to certain exemplary embodiments, various modifications of these embodiments, as well as alternative embodiments, will be suggested to those skilled in the art. The invention encompasses any modifications or alternative embodiments that fall within the scope of the claims.

What is claimed is:

1. An image generation system, comprising:

an image source for providing a beam of light incorporating said image;

an optics system disposed between the image source and a user for directing said beam of light to at least one eye of the user, such that the illuminated image is initially displayed within said at least one eye of the user; and measurement circuitry for continually determining the distance of said user from said image generation system, said measurement circuitry cooperating with said optics system to provide an in-focus image to said at least one eye of said user.

2. The image generation system of claim 1 and further comprising an image detector for determining a direction for said beam of light.

3. The image generation system of claim 2 wherein said image detector includes a charged coupled device for receiving an image of the user's face.

4. The image generation system of claim 3 wherein said image detector further includes circuitry for locating features in said image of the user's face.

5. The image generation system of claim 2 and further comprising an electrically controllable mount coupled to said optics system to mechanically direct said beam of light responsive to said image detector.

6. The image generation system of claim 5 wherein said image detector further includes circuitry for locating features in said image of the user's face.

7. The image generation system of claim 5 wherein movement of said mount is controlled by at least one stepper motor.

8. The image generation system of claim 5 wherein said image detector tracks both lateral and horizontal movement of the user.

9. The image generation system of claim 1 and further comprising a focus detector for determining an optical characteristics for the eye of the user.

10. The image generation system of claim 1 wherein said optics system includes a plurality of lenses between said image source and said at least one eye of said user.

11. The image generation system of claim 10 wherein at least one of said lenses is movable to vary the focus of the beam of light.

12. The image generation system of claim 1, wherein said optics system controls the distance at which said at least one eye focuses on said image.

13. The image generation system of claim 1, wherein an image is produced on the retina of said at least one eye.

14. The image generation system of claim 13, wherein focus of said image produced on the retina of said at least one eye is provided by said optics system cooperating with a lens in said user's at least one eye.

15. The image generation system of claim 1 wherein there are at least two lens between the image source and an eye of the user.

16. A computer system comprising:

a processing device for outputting data defining an image; and an image generation system coupled to said processing device comprising:

an image source for providing a beam of light incorporating said image;

an optics system disposed between the image source and a user for directing said beam of light to at least one eye of the user, such that the illuminated image is initially displayed within said at least one eye of the user; and measurement circuitry for continually determining the distance of said user from said image generation system, said measurement circuitry cooperating with said optics system to provide an in-focus image to said at least one eye of said user.

17. The computer system of claim 16 wherein said image generation system further comprises an image detector for determining a direction for said beam of light.

18. The computer system of claim 17 wherein said image detector includes a charged coupled device for receiving an image of the user's face.

19. The computer system of claim 18 wherein said image detector further includes circuitry for locating features in said image of the user's face.

20. The computer system of claim 17 wherein said image generation system further comprises an electrically controllable mount coupled to said optics system to mechanically direct said beam of light responsive to said image detector.

21. The computer system of claim 16 wherein said image generation system further comprises a focus detector for determining an optical characteristics for the eye of the user.

22. The computer system of claim 16 wherein said optics system includes a plurality of lenses.

23. The computer system of claim 22 wherein at least one of said lenses is movable to vary the focus of the beam of light.

24. An image generation system for providing an image to a user comprising:

an image source for providing a beam of light incorporating said image; and an optics system disposed between the image source and the user for directing said beam of light to an eye of the user, said optics system including:

a plurality of lenses between said image source and an eye of the user; and a control system for positioning individual ones of said lenses such that the illuminated image is in focus when initially displayed within an eye of the user at variable perceived distances, wherein said control system includes measurement circuitry for continually determining the distance of said user from said image generation system, said control system providing an in-focus image to said at least one eye of said user.

25. The image generation system of claim 24 wherein said control system positions individual ones of said lenses to adjust the size of the image received by the user.

26. The image generation system of claim 24 wherein said image source includes a digital mirror device.

27. An image generation system, comprising:

a first image source for providing a first beam of light incorporating a first image;

a first optics system disposed between the first image source and a user for directing said first beam of light to one eye of the user, such that the illuminated image is initially displayed within said one eye of the user;

a second image source for providing a second beam of light incorporating a second image;

a second optics system disposed between the second image source and the user for directing said second beam of light to another eye of the user, such that the illuminated image is initially displayed within said another eye of the user; and measurement circuitry for continually determining the distance of said user from said image generation system, said measurement circuitry cooperating with said first and second optics systems to provide in-focus images to said eyes of said user.

28. The image generation system of claim 27, wherein said first image and said second image are identical.

29. The image generation system of claim 27, wherein said first image and said second image are of slightly different perspective, thereby producing a three dimensional effect.

* * * * *